US011445868B2

(12) United States Patent
Penny

(10) Patent No.: US 11,445,868 B2
(45) Date of Patent: Sep. 20, 2022

(54) POTTY CHAIR COVER

(71) Applicant: Elease Penny, Baltimore, MD (US)

(72) Inventor: Elease Penny, Baltimore, MD (US)

(73) Assignee: Elease Penny, Baltimore, MD (US)

( * ) Notice: Subject to any disclaimer, the term of this patent is extended or adjusted under 35 U.S.C. 154(b) by 12 days.

(21) Appl. No.: 17/033,780

(22) Filed: Sep. 26, 2020

(65) Prior Publication Data

US 2022/0095860 A1 Mar. 31, 2022

(51) Int. Cl.

| | |
|---|---|
| ***A47K 13/14*** | (2006.01) |
| ***A47K 11/04*** | (2006.01) |
| ***A47C 31/11*** | (2006.01) |

(52) U.S. Cl.

CPC ..... *A47K 13/14* (2013.01); *A47C 31/11* (2013.01); *A47K 11/04* (2013.01)

(58) Field of Classification Search

CPC ..... A47K 13/14; A47K 11/04; A47C 31/11
USPC ..... 4/483
See application file for complete search history.

(56) References Cited

U.S. PATENT DOCUMENTS

| | | | | |
|---|---|---|---|---|
| 2,091,825 | A * | 8/1937 | Mednick | A47C 31/11 297/224 |
| 4,586,202 | A * | 5/1986 | Uchida | A47K 13/14 4/245.5 |
| 6,398,301 | B1 | 6/2002 | Illulian | |
| 7,637,567 | B2 | 12/2009 | Neustat et al. | |
| 8,038,211 | B2 | 10/2011 | Berk et al. | |
| 9,999,305 | B1 | 6/2018 | Dryer et al. | |
| 2012/0146371 | A1* | 6/2012 | Cotton | A47C 31/11 297/219.1 |
| 2018/0344109 | A1* | 12/2018 | Lucas | A47K 13/18 |

OTHER PUBLICATIONS

"The Dignity Cover," https://cdn.shopify.com/s/files/1/0066/6662/files/Bedside_Commode_Slipcover_Brochure.pdf.

* cited by examiner

*Primary Examiner* — Huyen D Le
(74) *Attorney, Agent, or Firm* — Tinch Law Firm P.C.

(57) ABSTRACT

Implementations of a potty chair cover comprising at least two interconnected panels and adapted for a potty chair. Implementations of a potty chair cover comprising at least three interconnected panels and adapted for a potty chair.

13 Claims, 9 Drawing Sheets

POTTY CHAIR COVER

TECHNICAL FIELD

This disclosure is specifically related to accessories for toilet training devices.

BACKGROUND

A potty chair cover for a potty chair is disclosed herein. "Potty chair" as used herein refers to a device used to facilitate the toilet training process—the process of teaching a toddler to use a toilet.

"Inseam" as used herein refers to a seam that binds a length of fabric from the top of the potty chair to the bottom.

"Fabric fastener" as used herein refers to a mechanism for fastening fabric, like a button, hook, zipper, Velcro, etc.

"Splash guard" as used herein refers to a raised portion on the front of a potty chair seat. A splash guard may or may not be integrated into the potty chair seat.

In reference to the numbering of edges, edges are numbered in ascending order in the clockwise direction from the first edge in the 12:00 position. The next edge in order is the next adjacent edge. For example, for a square, the first edge faces the 12:00 position, the second edge faces the 3:00 position, etc.

BRIEF SUMMARY OF THE DISCLOSURE

Implementations of a potty chair cover are shown and described herein.

In implementations, a potty chair cover may comprise: a seat panel having a circumference; a skirt panel having four edges; wherein the circumference of the seat panel is joined at the first edge of the skirt panel; and wherein the second edge of the skirt panel is joined at the fourth edge of the skirt panel.

In implementations, a potty chair cover may comprise: a seat panel having a circumference; a skirt panel having four edges; wherein the circumference of the seat panel is joined at the first edge of the skirt panel to form a first pocket and a second pocket; and wherein a second edge of the skirt panel is joined at a fourth edge of the skirt panel.

In implementations, a potty chair cover may comprise: A first panel having eight edges; A second panel having four edges; A third panel having four edges; wherein a third edge of the first panel is joined at a fourth edge of the first panel wherein a sixth edge of the first panel is joined at a seventh edge of the first panel; wherein a third edge of the second panel is joined at a first edge of the first panel; wherein a fourth edge of the third panel is joined at a fourth edge of the second panel and the first edge of the first panel; and wherein a second edge of the third panel is joined at a second edge of the second panel and the first edge of the first panel.

BRIEF DESCRIPTION OF THE SEVERAL VIEWS OF THE DRAWINGS

Implementations of a potty chair cover are illustrated in FIGS. 1-13.

DETAILED DESCRIPTION OF THE INVENTION

FIGS. 1-13 show implementations of a potty chair cover. It should be understood that the scope of the disclosure should not be limited to the implementations shown and described herein.

Detailed Description of FIGS. 1-4

Figure 1:
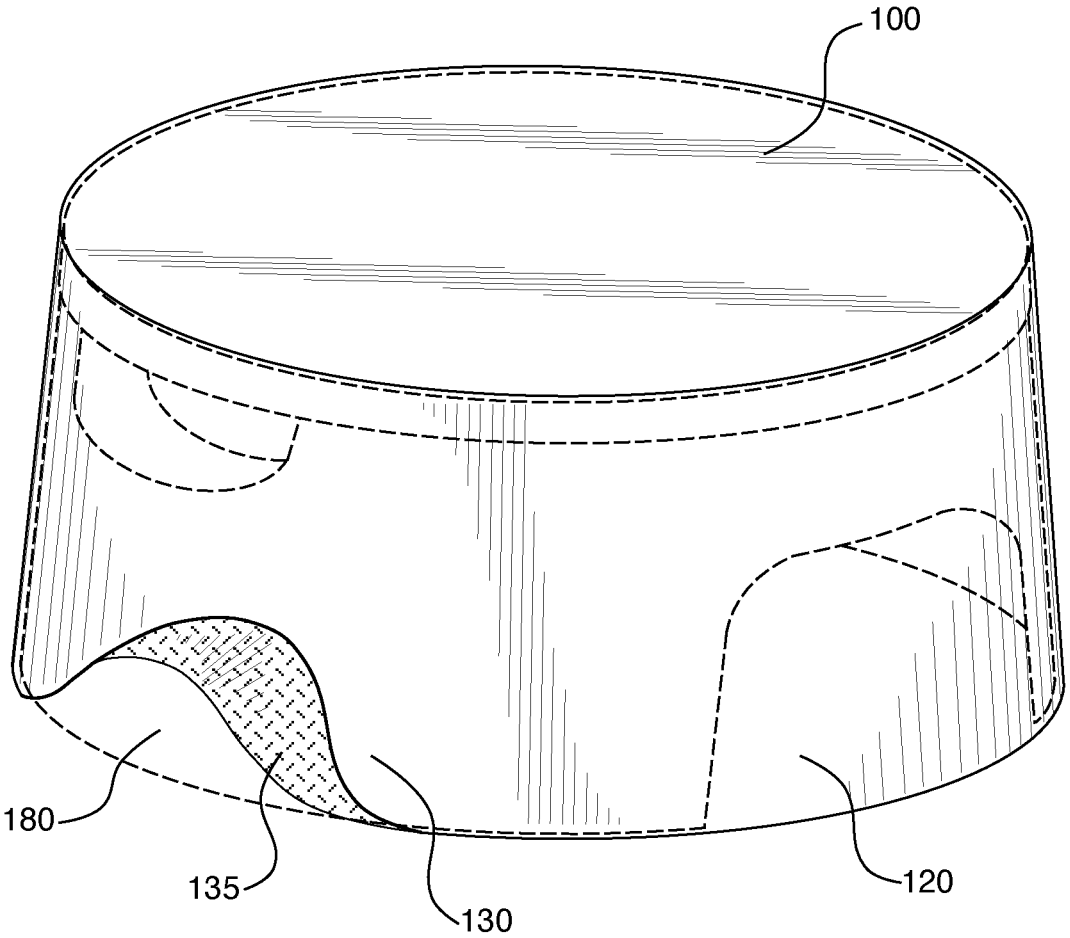
FIG. 1 is a perspective view of an implementation of a potty chair cover as it may be used with an exemplary potty chair.

FIG. 1 is a perspective view of an implementation of a potty chair cover as it may be used with an exemplary potty chair. An exemplary potty chair 180, denoted in FIG. 1 by broken lines, may have a base, a backrest attached to the base at a hinge, and wherein the backrest may be collapsed onto the base. An exemplary potty chair 180 may be configured such that the backrest is collapsed onto the base. In implementations, the dimensions of an exemplary potty chair 180 may be approximately 7.7 inches high, 12.7 inches wide, and 14.8 inches deep.

According to the implementation shown in FIG. 1, a potty chair cover may comprise a seat panel 100 having a circumference, a skirt panel 120 having four edges, wherein the circumference of seat panel 100 is joined at the first edge of skirt panel 120, and wherein the second edge of skirt panel 120 is joined at the fourth edge of skirt panel 120.

In implementations of a potty chair cover, a seat panel 100 and a skirt panel 120 may be fabric. In implementations of a potty chair cover, a seat panel 100 and a skirt panel 120 may be woven fabric. In implementations of a potty chair cover, a seat panel 100 and a skirt panel 120 may be stretch fabric.

In implementations of a potty chair cover, a seat panel 100 and a skirt panel 120 may further comprise a first face and a second face. In implementations of a potty chair cover, a first face of a seat panel 100 and a first face of a skirt panel 120 may have a first pattern 130. In implementations of a potty chair cover, a second face of a seat panel 100 and a second face of a skirt panel 120 may have a second pattern 135.

Figure 2:
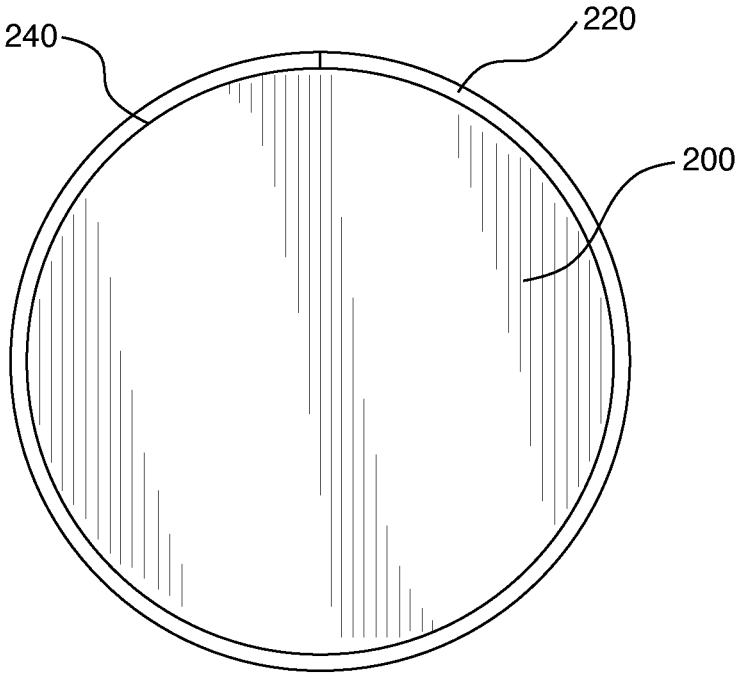
FIG. 2 is a top view of an implementation of a potty chair cover as it may be used with an exemplary potty chair.

FIG. 2 is a top view of an implementation of a potty chair cover. In implementations of a potty chair cover, a circumference of a seat panel 200 may be bound to a first edge of a skirt panel 220 by a seam 240. In implementations of a potty chair cover, a circumference of a seat panel 200 may overlap with a first edge of a skirt panel 220 by one-half inch such that a seam 240 may be applied to bind seat panel 200 to skirt panel 220. In implementations of a potty chair cover, the length of a seam 240 may be approximately 44 inches.

Figure 3:
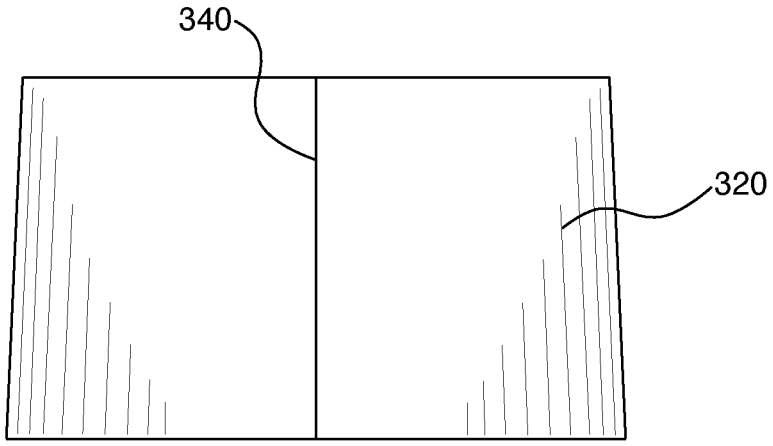
FIG. 3 is a rear view of an implementation of a potty chair cover as it may be used with an exemplary potty chair.

FIG. 3 is a rear view of an implementation of a potty chair cover. In implementations of a potty chair cover, a second edge of a skirt panel 320 may be joined at a fourth edge of a skirt panel 320 and bound by an inseam 340. In implementations of a potty chair cover, a second edge of a skirt panel 320 may overlap with a fourth edge of skirt panel 320 by one-half inch such that an inseam 340 may be applied to bind the second edge of skirt panel 320 to the fourth edge of skirt panel 320. In implementations of a potty chair cover, the length of an inseam 340 may be within the range 7.5 inches to 9 inches. In implementations of a potty chair cover, a skirt panel 320 may be hemmed along a third edge such that the length of an inseam at a juncture of a second edge and a fourth edge of skirt panel 320 meets a certain specification.

Figure 4:
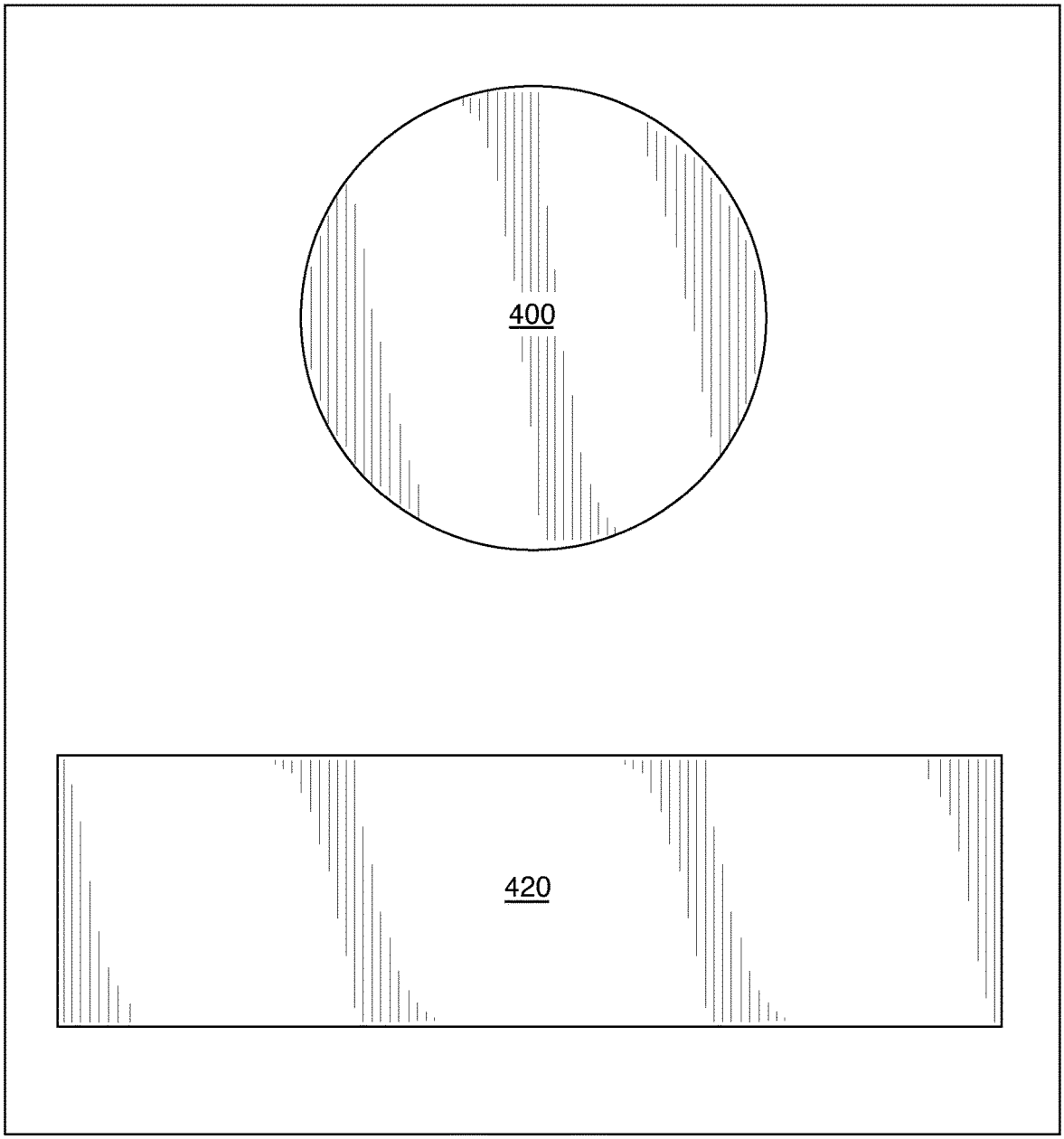
FIG. 4 shows component panels of an implementation of a potty chair cover.

FIG. 4 shows component panels of an implementation of a potty chair cover. In implementations, a potty chair cover may comprise a generally elliptical seat panel 400. In implementations of a potty chair cover, a seat panel 400 may have a short diameter within the range of 12.5 to 13.5 inches and a long diameter within the range 13.5 to 14.5 inches.

In implementations, a potty chair cover may comprise a generally rectangular skirt panel 420. In implementations, a potty chair cover seat panel 420 may have four edges: a first edge may face the 12:00 direction; a second edge may face the 3:00 direction; a third edge may face the 6:00 position; and a fourth edge may face the 9:00 direction. In implementations of a potty chair cover, a first edge and a third edge of a skirt panel 420 may be parallel, a second edge and a fourth edge of a skirt panel 420 may be parallel, and the first and third edges may be perpendicular to the second and fourth edges. In implementations of a potty chair cover, a first edge and a third edge of a skirt panel 420 may be approximately 41 inches long. In implementations of a potty chair cover, the length of a second edge and a fourth edge of skirt panel 420 may be within the range of approximately 40 to 42 inches long. In implementations of a potty chair cover, the length of a second edge and a fourth edge of skirt panel 420 may be approximately 8 inches. In implementations of a potty chair cover, the length of a first edge and a third edge of a skirt panel 420 may be within the range of approximately 7.5 to 9 inches.

Detailed Description of FIGS. 5-9

Figure 5:
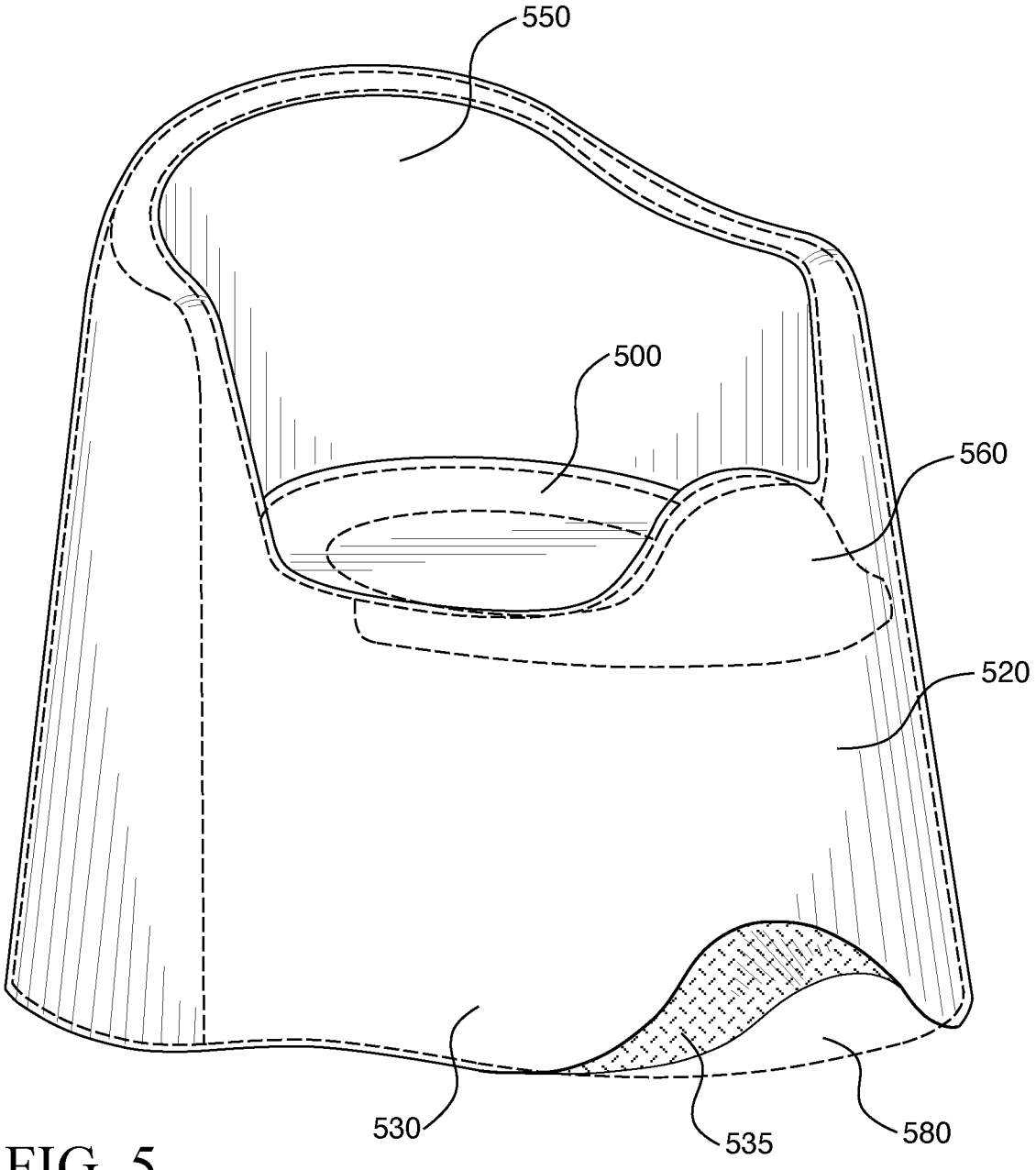
FIG. 5 is a perspective view of an implementation of a potty chair cover as it may be used with an exemplary potty chair.

FIG. 5 is a perspective view of an implementation of a potty chair cover as it may be used with an exemplary potty chair. An exemplary potty chair 580, denoted in FIG. 5 by broken lines, may comprise a base having a seat and a backrest, and wherein the seat has a splash guard. An exemplary potty chair 580 may have dimensions of approximately 12.25 inches high, 13.75 inches wide, and 15 inches deep.

In implementations, a potty chair cover may comprise: a seat panel 500 having a circumference, a skirt panel 520 having four edges, wherein the circumference of the seat panel 500 is joined at a first edge of a skirt panel 520 to form a first pocket 550 and a second pocket 560, and wherein a second edge of skirt panel 520 is joined at a fourth edge of skirt panel 520.

In implementations of a potty chair cover, a skirt panel 520 may be adapted to form a first pocket 550 and a second pocket 560. In implementations of a potty chair cover, a first pocket 550 may be adapted to cover a backrest of an exemplary potty chair 580 and a second pocket 560 may be adapted to cover a splash guard of an exemplary potty chair 580.

In implementations of a potty chair cover, a seat panel 500 and a skirt panel 520 may be fabric. In implementations of a potty chair cover, a seat panel 500 and a skirt panel 520 may be woven fabric. In implementations of a potty chair cover, a seat panel 500 and a skirt panel 520 may be stretch fabric.

In implementations of a potty chair cover, a seat panel 500 and a skirt panel 520 may further comprise a first face and a second face. In implementations of a potty chair cover, a first face of a seat panel 500 and a first face of a skirt panel 520 may be printed in a first pattern 530. In implementations of a potty chair cover, a first face of a seat panel 500 and a first face of a skirt panel 520 may be printed in a first pattern 530 and a second face of a seat panel 500 and a second face of a skirt panel 520 may be printed in a second pattern 535.

Figure 6:
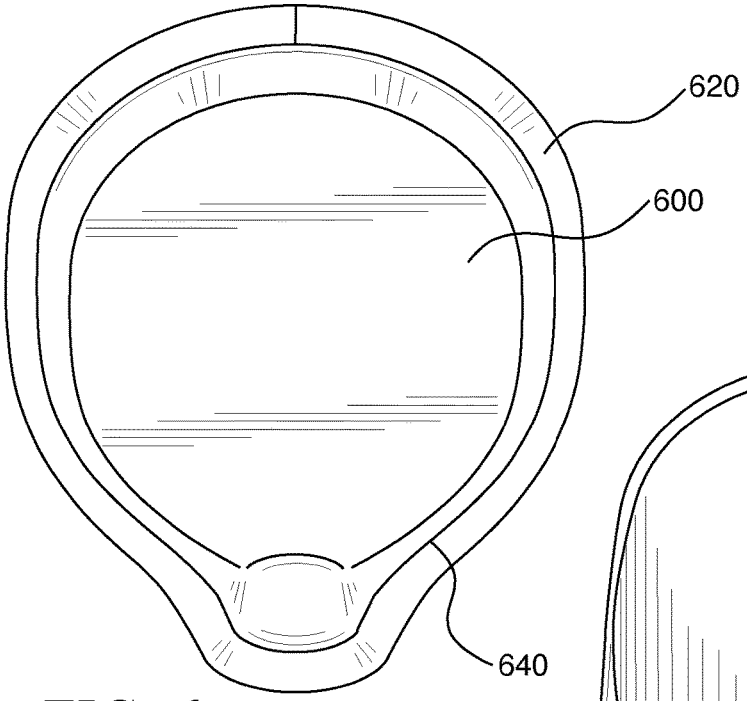
FIG. 6 is a top view of an implementation of a potty chair cover as it may be used with an exemplary potty chair.

FIG. 6 is a top view of an implementation of a potty chair cover. In implementations of a potty chair cover, a circumference of a seat panel 600 may be bound to a first edge of a skirt panel 620 by a seam 640. In implementations of a potty chair cover, a circumference of a seat panel 600 may overlap with a first edge of a skirt panel 620 by one-half inch such that seat panel 600 may be bound to skirt panel 620 by a seam 640. In implementations of a potty chair cover, the length of a seam 640 may be approximately 56 inches.

Figure 7:
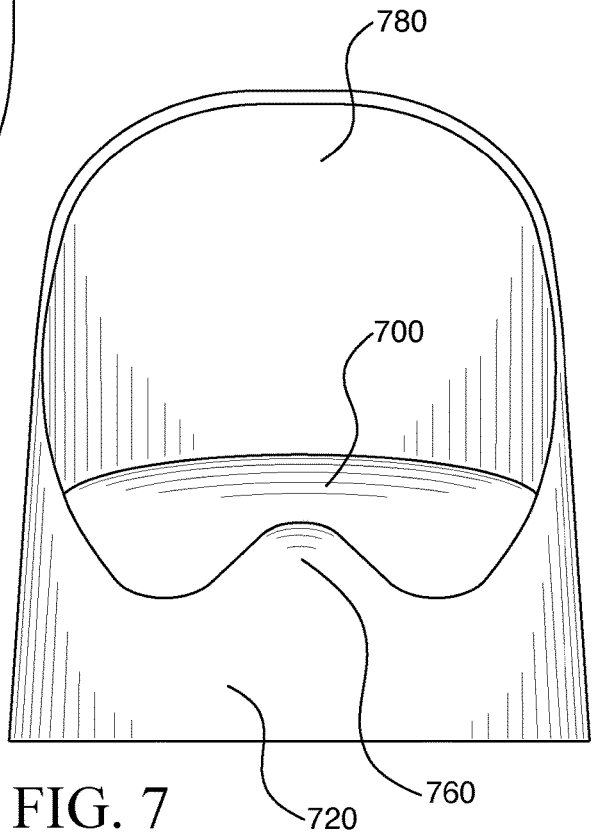
FIG. 7 is a front view of an implementation of a potty chair cover as it may be used with an exemplary potty chair.

FIG. 7 is a front view of an implementation of a potty chair cover. In implementations, a potty chair cover may comprise a seat panel 700 and a skirt panel 720 joined to form a first pocket 750 and a second pocket 760. In implementations of a potty chair cover, first pocket 750 may be adapted to cover the backrest of an exemplary potty chair. In implementations of a potty chair cover, a second pocket 760 may be adapted to cover a splash guard of an exemplary potty chair.

Figure 8:
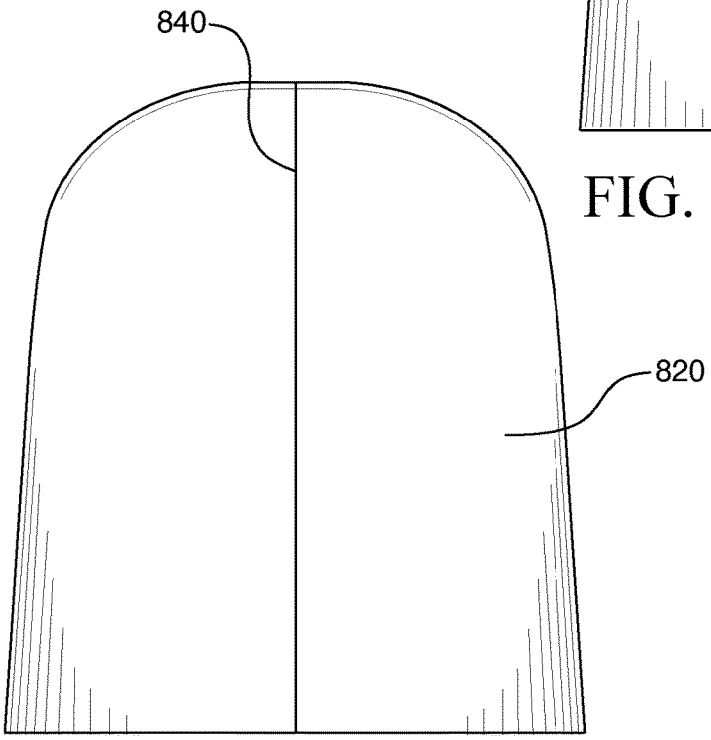
FIG. 8 is a rear view of an implementation of a potty chair cover as it may be used with an exemplary potty chair.

FIG. 8 is a rear view of an implementation of a potty chair cover. In implementations of a potty chair cover, a second edge of a skirt panel 820 may be bound to a fourth edge of a skirt panel 820 by an inseam 840. In implementations of a potty chair cover, a second edge of a skirt panel 820 may overlap with a fourth edge of a skirt panel 820 by one-half inch such that an inseam 840 may be applied to bind a second edge of a skirt panel 820 to a fourth edge of a skirt panel 820. In implementations of a potty seat cover, the length of an inseam 840 may be within the range 12 inches to 14 inches. In implementations of a potty chair cover, a skirt panel 820 may be hemmed along a third edge such that the length of an inseam at a juncture of a second edge and a fourth edge of skirt panel 820 meets a certain specification.

Figure 9:
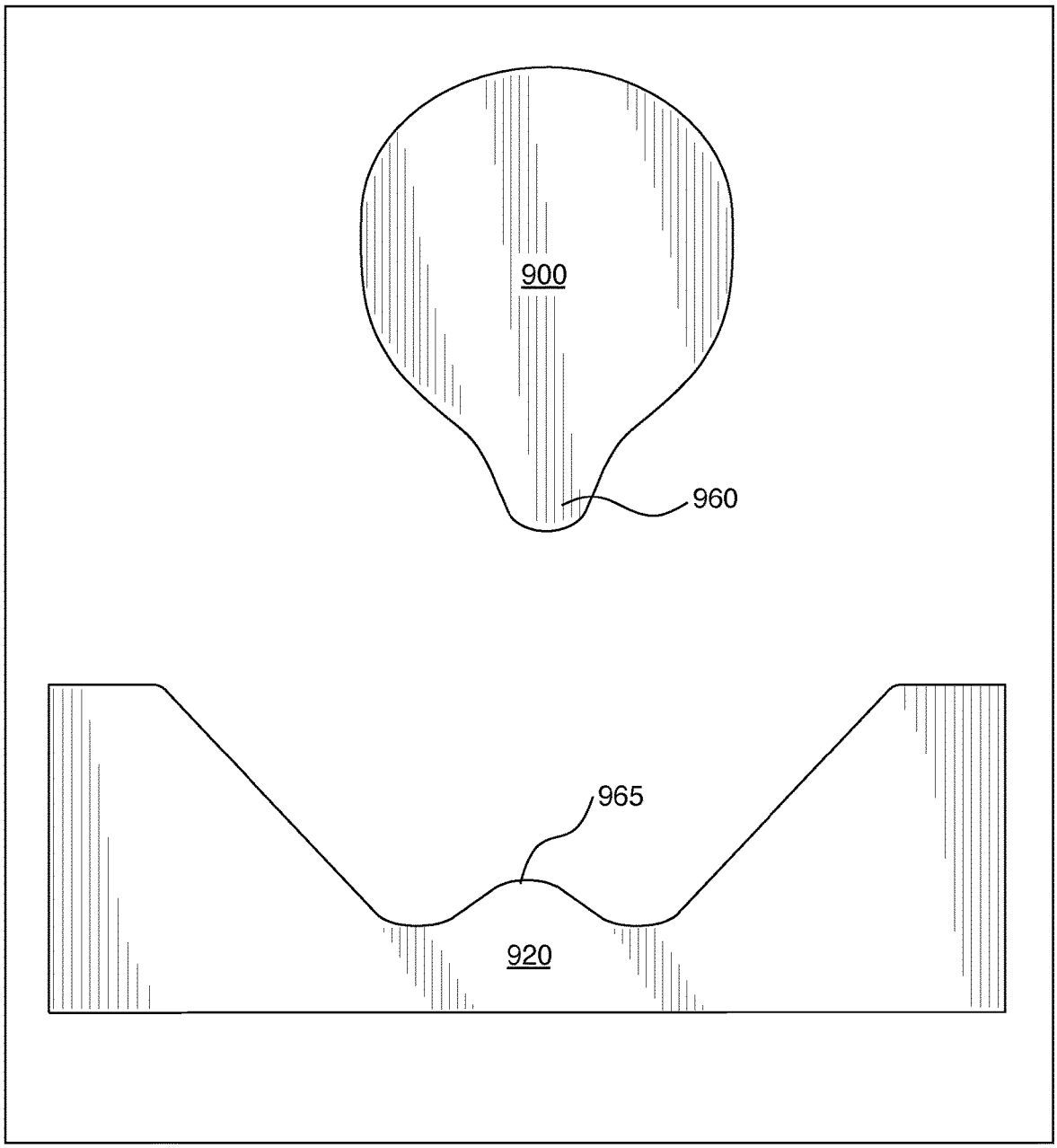
FIG. 9 shows component panels of an implementation of a potty chair cover.

FIG. 9 shows component panels of an implementation of a potty chair cover. In implementations of a potty chair cover, a seat panel 900 may be generally elliptical. In implementations of a potty chair cover, a seat panel 920 may have a short diameter of 16.5 inches and a long diameter of 19 inches. In implementations, a seat panel 920 may further comprise a lip 960 adapted to form a second pocket at a juncture with a seat panel 920. In implementations of a potty chair cover, a lip 960 may be approximately 8 inches in diameter.

In implementations of a potty chair cover, a skirt panel 920 may have four edges: a first edge may face the 12:00 direction; a second edge may face the 3:00 direction; a third edge may face the 6:00 direction; and a fourth edge may face the 9:00 position. In implementations of a potty chair cover, a second edge and a fourth edge of a skirt panel 920 may be parallel. In implementations of a potty chair cover, a second edge and a fourth edge of a skirt panel 920 may be approximately 18.5 inches long. In implementations of a potty chair cover, a third edge of a skirt panel 920 may be parallel to a first edge and a second edge of a skirt panel 920. In implementations of a potty chair cover, a third edge of a skirt panel 920 may be approximately 45 inches long.

In implementations of a potty chair cover, a first edge of a skirt panel 920 may be adapted to follow the contours of a backrest of an exemplary potty chair to form a first pocket and a second pocket along a juncture at a circumference of seat panel 900 and a first edge of skirt panel 920. In implementations of a potty chair cover, a second pocket is formed where a seat panel lip 960 is joined at a skirt panel lip 965. In implementations of a potty chair cover, a first pocket is formed along a juncture between a circumference of seat panel 900 and a first edge of skirt panel 920 opposite a second pocket located at a juncture of seat panel lip 960 and skirt panel lip 965.

Detailed Description of FIGS. 10-13

Figure 10:
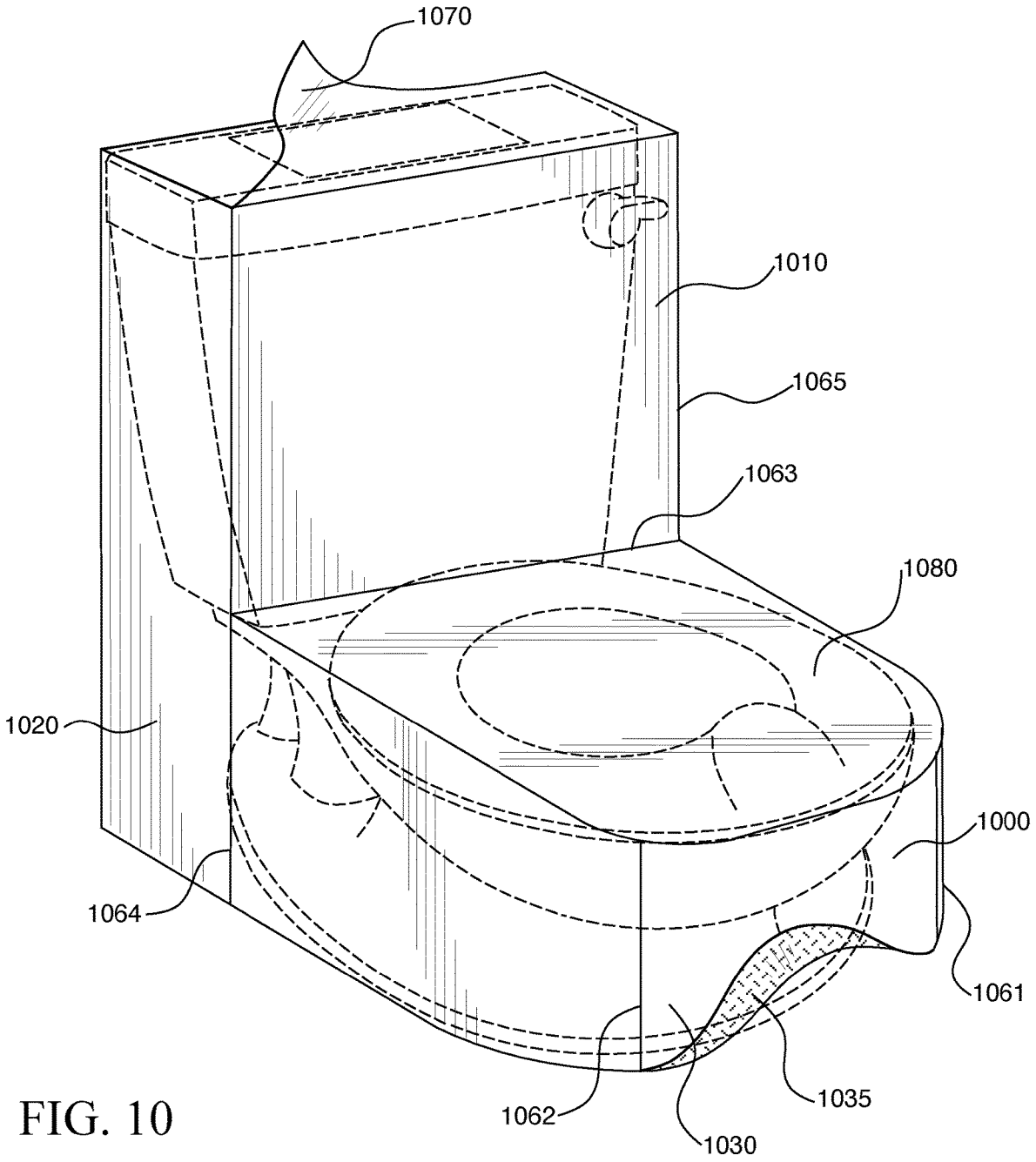
FIG. 10 is a perspective view of an implementation of a potty chair cover as it may be used with an exemplary potty chair.

FIG. 10 is a perspective view of an implementation of a potty chair cover as it may be used with an exemplary potty chair. An exemplary potty chair 1080 as shown in FIG. 10, and denoted by broken lines, may comprise a base having a seat and a backrest. In implementations, the dimensions of an exemplary potty chair may be approximately 15 inches high, 11 inches wide and 15 inches deep.

In implementations, a potty chair cover may comprise: a first panel 1000 having eight edges; a second panel 1010 having four edges; a third panel 1020 having four edges; wherein the third edge of the first panel 1000 is joined at the fourth edge of the first panel 1000; wherein the sixth edge of the first panel 1000 is joined at the seventh edge of the first panel 1000; wherein the third edge of the second panel 1010 is joined at the first edge of the first panel 1000; wherein the fourth edge of the third panel 1020 is joined at the fourth edge of the second panel 1010 and the first edge of the first panel 1000; and wherein the second edge of the third panel 1020 is joined at the second edge of the second panel 1010 and the first edge of the first panel 1000.

In implementations of a potty chair cover, each of a first panel 1000, a second panel 1010, and a third panel 1020 may be fabric. In implementations of a potty chair cover, each of a first panel 1000, a second panel 1010, and a third panel 1020 may be woven fabric. In implementations of a potty chair cover, each of a first panel 1000, a second panel 1010, and a third panel 1020 may be stretch fabric.

In implementations of a potty chair cover, each of a first panel 1000, a second panel 1010, and a third panel 1020 may further comprise a first face and a second face. In implementations of a potty chair cover, a first face of each of a first panel 1000, a second panel 1010, and a third panel 1020 may be printed in a first pattern 1030. In implementations of a potty chair cover, a first face of each of a first panel 1000, a second panel 1010, and a third panel 1020 may be printed in a first pattern and a second face of each of a first panel 1000, a second panel 1010, and a third panel 1020 may be printed in a second pattern 1035.

In implementations of a potty chair cover, a third edge of a first panel 1000 may be bound to a fourth edge of first panel 1000 by a first corner seam 1061. In implementations of a potty chair cover, a sixth edge of a first panel 1000 may be bound to a seventh edge of first panel 1000 by a second corner seam 1062. In implementations of a potty chair cover, a third edge of a second panel 1010 may be joined at a first edge of first panel 1000 and bound by a panel seam 1063.

In implementations of a potty chair cover, the midpoint of a first edge of a first panel 1000 may be joined at the midpoint of a third edge of a second panel 1010 such that the first edge of first panel 1000 is contiguous with the third edge of second panel 1010 and the first edge of second panel 1010 is also contiguous with the first edge of first panel 1000. In implementations of a potty chair cover, a fourth edge of a third panel 1020 may be bound to a fourth edge of a second panel 1010 and a first edge of a first panel 1000 by a first panel inseam 1064. In implementations of a potty chair cover, a second edge of third panel 1020 may be bound to a second edge of a second panel 1010 and a first edge of a first panel 1000 by a second panel inseam 1065. In implementations of a potty chair cover, a first corner seam 1061 and a second corner seam 1062 may be approximately 6.5 inches in length. In implementations of a potty chair cover, a first panel inseam 1064 and a second panel inseam 1065 may be in the range approximately 11 inches to approximately 19 inches.

In implementations of a potty chair cover, the first edge of a second panel 1010 is not joined at the first edge of a third panel 1020 to form a flap opening 1070. In implementations of a potty chair cover, the first edge of a second panel 1010 may be joined at the first edge a third panel 1020 by a fabric fastener to secure a flap opening 1070. In implementations of a potty chair cover, a flap opening 1070 may facilitate access to the backrest of an exemplary potty chair 1080 without removing the potty chair cover.

Figure 11:
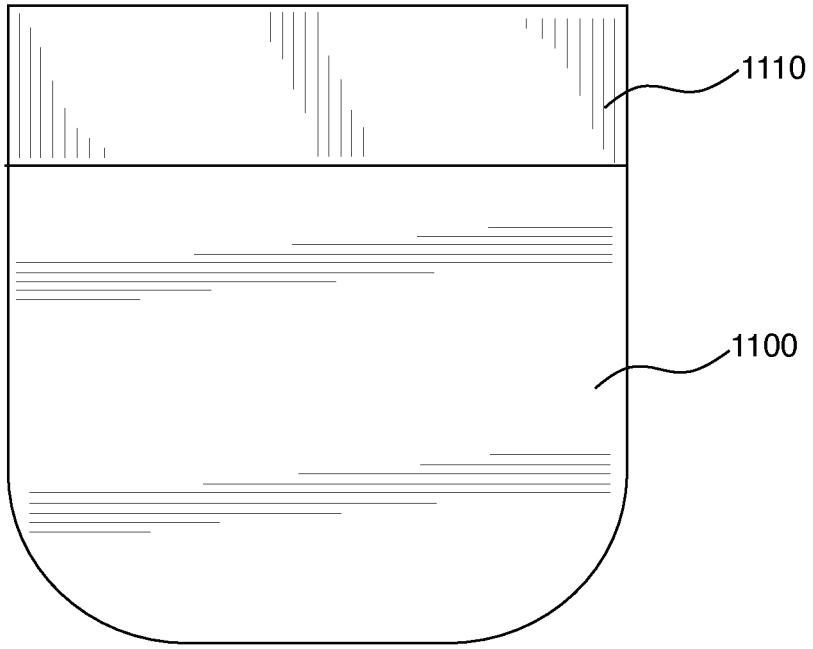
FIG. 11 is a top view of an implementation of a potty chair cover as it may be used with an exemplary potty chair.

FIG. 11 is a top view of an implementation of a potty chair cover as it may be used with an exemplary potty chair. FIG. 11 shows a first panel 1100 and a second panel 1110 according to an implementation of a potty chair cover.

Figure 12:
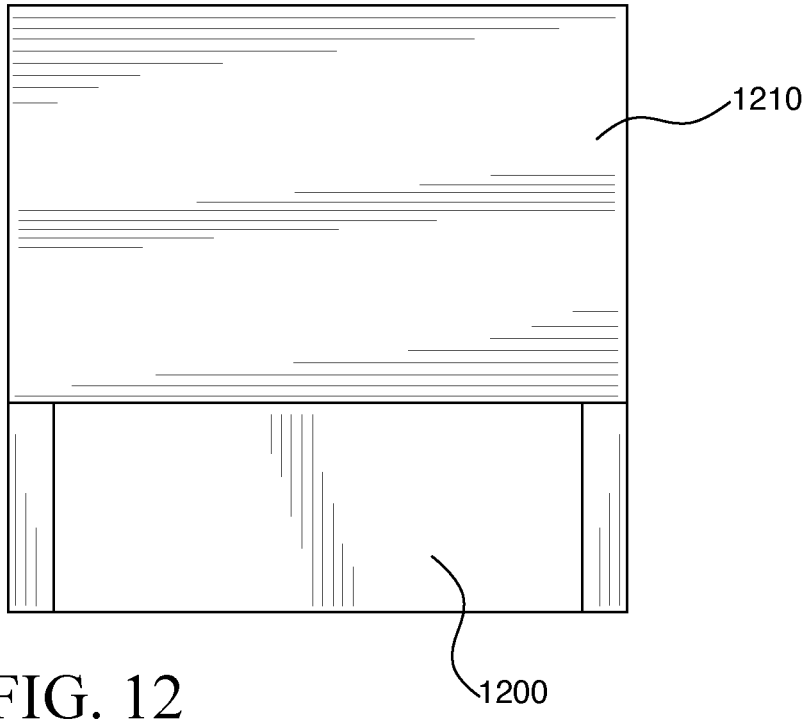
FIG. 12 is a front view of an implementation of a potty chair cover as it may be used with an exemplary potty chair.

FIG. 12 is a front view of an implementation of a potty chair cover as it may be used with an exemplary potty chair. FIG. 12 shows a first panel 1200 and a second panel 1210 according to an implementation of a potty chair cover.

Figure 13:
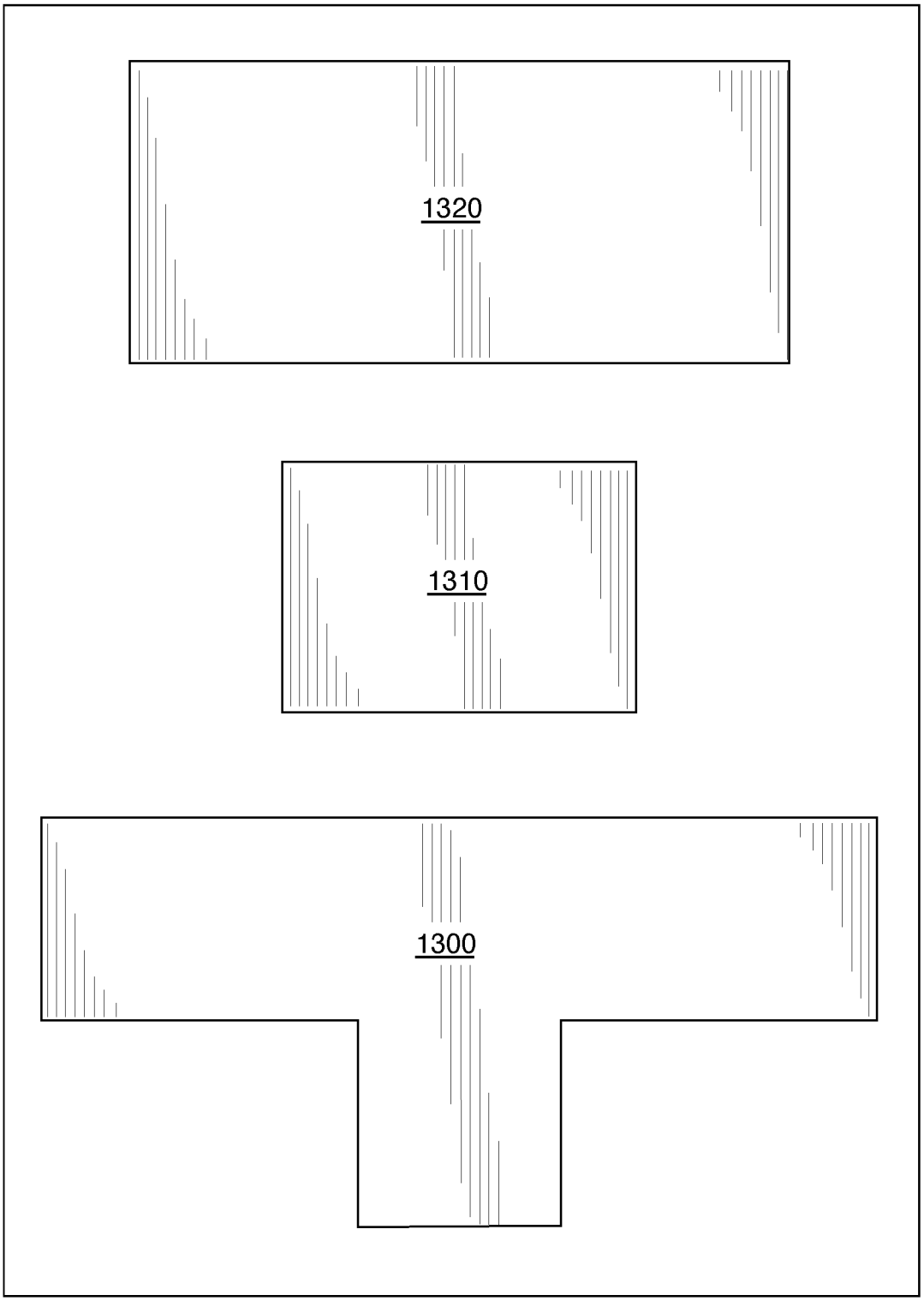
FIG. 13 shows component panels of an implementation of a potty chair cover.

FIG. 13 shows component panels of an implementation of a potty chair cover. In implementations of a potty chair cover, a first panel 1300 may be generally T-shaped having eight edges. In implementations of a potty chair cover, the dimensions of a first panel 1300, where edges may be numbered in ascending order in the clockwise direction from the first edge facing the 12:00 direction, may be as follows: a first edge may be approximately 24 inches in length; a second edge may be approximately 6.5 inches in length; a third edge may be approximately 11 inches in length; a fourth edge may be approximately 6.5 inches in length; a fifth edge may be approximately 11 inches in length, a sixth edge may be approximately 6.5 inches in length; a seventh edge may be approximately 6.5 inches in length, and an eighth edge may be approximately 11 inches in length.

In implementations, a potty chair cover may have a generally square second panel 1310 having four edges. In implementations of a potty chair cover, where the edges of a second panel 1310 may be numbered in ascending order in the clockwise direction from a first edge facing the 12:00 direction, may be oriented such that: a first edge and a third edge may be parallel; a second edge and a fourth edge may be parallel; and a first edge and a third edge may be perpendicular to the second and the fourth edges. In implementations of a potty chair cover, a first edge and a third edge of a second panel 1310 may be approximately 10.5 inches in length. In implementations of a potty chair cover, a second edge and a fourth edges of a second panel 1310 may be approximately 13 inches in length.

In implementations, a potty chair cover may have a generally rectangular third panel 1320 having four edges. In implementations of a potty chair cover, where the edges of a third panel 1320 may be numbered in ascending order in the clockwise direction from the first edge facing the 12:00 direction, may be oriented such that a first edge and a third edge of the third panel 1320 may be parallel and perpendicular to a second edge and a fourth edge of the third panel 1320. In implementations of a potty chair cover, a first edge and a third edge of a third panel 1320 may be approximately 19 inches in long. In implementations of a potty chair cover, a second edge and a fourth edge of a third panel 1320 may be approximately 16.5 inches long.

While specific implementations of the article have been described in detail, it will be appreciated by those skilled in the art that additional implementations could be developed in light of the overall teachings of the disclosure. Accordingly, the particular implementations disclosed are meant to be illustrative only and not limiting as to the scope of the article, which is to be given the full breadth of the appended claims and any equivalents thereof.

I claim:

1. A potty chair cover comprising:
a seat panel having a circumference;
a skirt panel having four edges;
wherein the circumference of the seat panel is joined at the first edge of the skirt panel; and
wherein the second edge of the skirt panel is joined at the fourth edge of the skirt panel.

2. The potty chair cover according to claim 1, adapted to fit a base having a backrest attached at a hinge, and wherein the backrest is collapsed onto the base.

3. The potty chair cover according to claim 1, wherein the circumference of the seat panel is bound to the first edge of the skirt panel at a first seam; and
wherein the second edge of the skirt panel is bound to the fourth edge of the skirt panel at a second seam.

4. The potty chair cover according to claim 1, wherein the seat panel and the skirt panel are formed from fabric.

5. The potty chair cover according to claim 1, further comprising:
a seat panel having a first face and a second face;
a skirt panel having a first face and a second face;
wherein the first face of the seat panel having a first pattern; and
wherein the first face of the skirt panel having a first pattern.

6. The potty chair cover of claim 1, further comprising:
a seat panel having a first face and a second face;
a skirt panel having a first face and a second face;
wherein the first face of the seat panel and the first face of the skirt panel having a first pattern; and
wherein the second face of the seat panel and the second face of the skirt panel having a second pattern.

7. The potty chair cover according to claim 1, adapted to fit a potty chair having a base, and wherein the base has a backrest and a seat on top of the base.

8. A potty chair cover comprising:
a seat panel having a circumference;
a skirt panel having four edges;
wherein the circumference of the seat panel is joined at the first edge of the skirt panel to form a first pocket and a second pocket; and
wherein a second edge of the skirt panel is joined at a fourth edge of the skirt panel.

9. The potty chair cover according to claim 8, wherein the circumference of the seat panel is joined at a first edge of the skirt panel by a first seam; and
wherein a second edge of the skirt panel is joined at a fourth edge of the skirt panel by a second seam.

10. The potty chair cover according to claim 8, wherein the seat panel and the skirt panel are made of fabric.

11. The potty chair cover according to claim 8, further comprising:
the seat panel having a first face and a second face;
the skirt panel having a first face and a second face;
wherein the first face of the seat panel having a first pattern; and
wherein the first face of the skirt panel having a first pattern.

12. The potty chair cover of claim 8, further comprising:
the seat panel having a first face and a second face;
the skirt panel having a first face and a second face;
wherein the first face of the seat panel having a first pattern and the second face of the seat panel having a second pattern; and
wherein the first face of the skirt panel having a first pattern and the second face of the skirt panel having a second pattern.

13. The potty chair cover of claim 8, further comprising:
the seat panel having a seat panel lip;
the skirt panel having a skirt panel lip; and
wherein the circumference of the seat panel is joined at the first edge of the skirt panel such that the seat panel lip is joined at the skirt panel lip.

* * * * *